US007470159B2

(12) United States Patent
Hara

(10) Patent No.: US 7,470,159 B2
(45) Date of Patent: Dec. 30, 2008

(54) FEMALE TERMINAL AND CONNECTOR

(75) Inventor: Terufumi Hara, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/601,679

(22) Filed: Nov. 20, 2006

(65) Prior Publication Data

US 2007/0123102 A1 May 31, 2007

(30) Foreign Application Priority Data

Nov. 28, 2005 (JP) ..... 2005-342597

(51) Int. Cl.
*H01R 11/22* (2006.01)

(52) U.S. Cl. ..... 439/852; 439/595

(58) Field of Classification Search ..... 439/595, 439/842, 851, 852

See application file for complete search history.

(56) References Cited

U.S. PATENT DOCUMENTS 5,427,553 A * 6/1995 Tsuji ..... 439/851
5,443,592 A * 8/1995 Ittah et al. ..... 439/851
5,480,320 A * 1/1996 Saimoto ..... 439/852
5,630,738 A * 5/1997 Ito et al. ..... 439/852
5,707,259 A * 1/1998 Ishizuka et al. ..... 439/852
5,735,717 A * 4/1998 Nabeshima ..... 439/851
6,066,009 A * 5/2000 Yamamoto ..... 439/852
6,095,873 A * 8/2000 Muramatsu et al. ..... 439/852
6,116,970 A * 9/2000 Yamamoto et al. ..... 439/852
6,152,788 A * 11/2000 Hata et al. ..... 439/852
6,386,928 B2 * 5/2002 Kitamura ..... 439/852
6,478,636 B1 * 11/2002 Makita et al. ..... 439/852
6,544,080 B1 * 4/2003 Yamamoto ..... 439/849

FOREIGN PATENT DOCUMENTS

JP 2001-210418 8/2001

* cited by examiner

*Primary Examiner*—Thanh-Tam T Le
(74) *Attorney, Agent, or Firm*—Kratz, Quintos & Hanson, LLP

(57) ABSTRACT

The present invention is to provide a female terminal for preventing an inserting segment from separating from one inner wall of a tube, and a connector utilizing the same. The female terminal has an electrical contacting portion and a projection. The electrical contacting portion has the tube accepting the inserting segment of a mating male terminal and a spring piece to be electrically connected with the inserting segment. The spring piece urges the inserting segment against the one inner wall of the tube and sandwiches the inserting segment with the one inner wall. A projection inwardly extends from another inner wall of the tube. The projection abuts on the inserting segment when the inserted segment separates from the one inner wall in a direction perpendicular to an inserting direction of the inserting segment so as to regulate the inserting segment to separate from the one inner wall.

4 Claims, 12 Drawing Sheets

FEMALE TERMINAL AND CONNECTOR

BACKGROUND OF THE INVENTION

1. Field of the Invention

The present invention relates to a female terminal for holding a belt-shaped inserting segment for electrical connection and a connector having the same.

2. Description of the Related Art

A motor vehicle has a wire harness for supplying a signal and electrical power to a variety of electronic devices mounted therein. The wire harness has a plurality of electrical wires and connectors attached to ends of the electrical wires. JP, 2001-210418,A discloses that each connector has a tube-shaped connector housing made of an insulating synthetic resin and a female terminal 50 received in the connector housing as depicted in FIG. 12.

The female terminal 50 has an electrical contacting portion 51 and an electrical wire connecting portion 52 attached to the electrical wire (not shown). The electrical wire connecting portion 52 is linked with the electrical contacting portion 51. The electrical contacting portion 51 has a tube 53 and a resilient contacting piece 54, which is bent and received in the tube 53. The tube 53 or the electrical contacting portion 51 accepts a male tab 56 of a male terminal 55.

The male terminal 55 has the male tab 56 with a plate shape as an inserting segment and an electrical wire connecting portion (not shown) attached to an electrical wire.

When the male tab 56 is inserted into the tube 53, the male tab 56 abuts on the resilient contacting piece 54 and is urged against an inner wall of the tube 53 with the resilient contacting piece 54 and sandwiched between the inner wall and the resilient contacting piece 54. The male terminal 55 is thereby electrically connected to the female terminal 50 with a top portion 57 of the resilient contacting piece 54 contacting the male tab 56.

In the conventional configuration, the female terminal 50 is relatively moved to the male tab 56 due to vibration of an motor vehicle engine disposed close to the connector. The male tab 56 thus slidably moves on the inner wall of the tube 53. The resilient contacting piece 54 thereby causes a plastic deformation and reduces the urging force against the male tab 56. The slidable contact between the male tab 56 and the top portion 57 of the resilient contacting piece 54 removes a plate plating thereof and causes oxidation thereof, resulting in an increase of resistance between the female and male terminals 50 and 55.

SUMMARY OF THE INVENTION

An object of the present invention is to provide a female terminal and a connector utilizing the same for preventing an increase of an electrical resistance between the female terminal and a mating terminal.

According to a first aspect of the present invention, a female terminal includes: an electrical wire connecting portion to be connected with an electrical wire; and an electrical contacting portion having a tube shape and connected to the electrical wire connecting portion, the electrical contacting portion having a tube for accepting an inserting segment of a mating terminal, a resilient piece, and a regulating portion, wherein the resilient piece urges the inserting segment against one inner wall of the tube and the regulating portion regulates the inserting segment to move away from the one inner wall.

Preferably, the regulating portion is a projection extending inwardly from another inner wall and abutting on either of the inserting segment or the resilient piece when the inserting segment separates away from the one inner wall.

Preferably, the female terminal further includes a contacting projection having a flat shape and disposed on the one inner wall in a longitudinal direction of the inserting segment so as to sandwich the inserting segment between the contacting projection and the resilient piece, wherein the projection is disposed inwardly from the center of the contacting projection against a front opening of the tube.

Preferably, the female terminal further includes a contacting projection having a flat shape and disposed on the one inner wall in a longitudinal direction of the inserting segment so as to sandwich the inserting segment between the contacting projection and the resilient piece, wherein the projection has a gap with respect to the contacting projection along the longitudinal direction of the inserting segment.

According to a second aspect of the present invention, a connector has the female terminal as disclosed above.

DETAILED DESCRIPTION OF THE PREFERRED EMBODIMENTS

Figure 1:
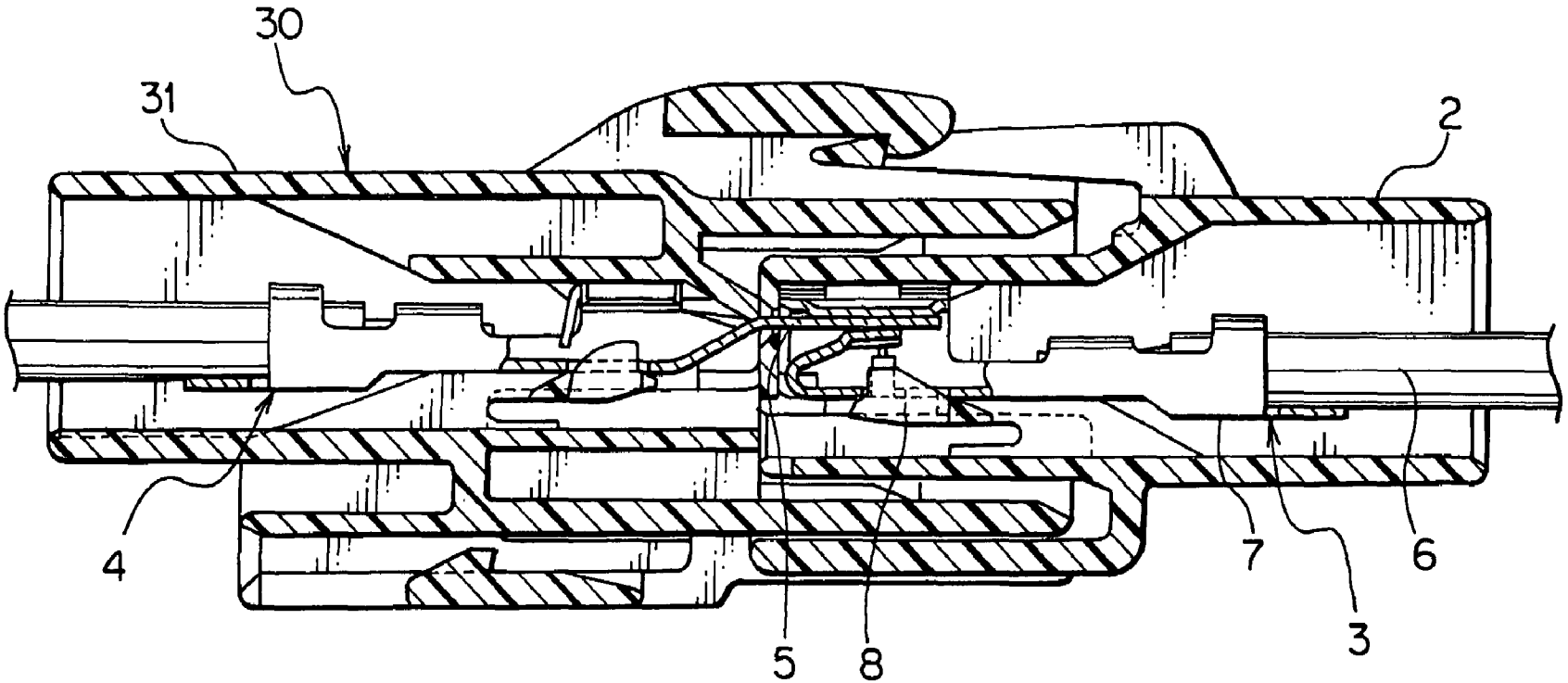
FIG. 1 is a side view with a partial section showing a fitting state of a first embodiment of a connector of the present invention and a mating connector.
Figure 2:
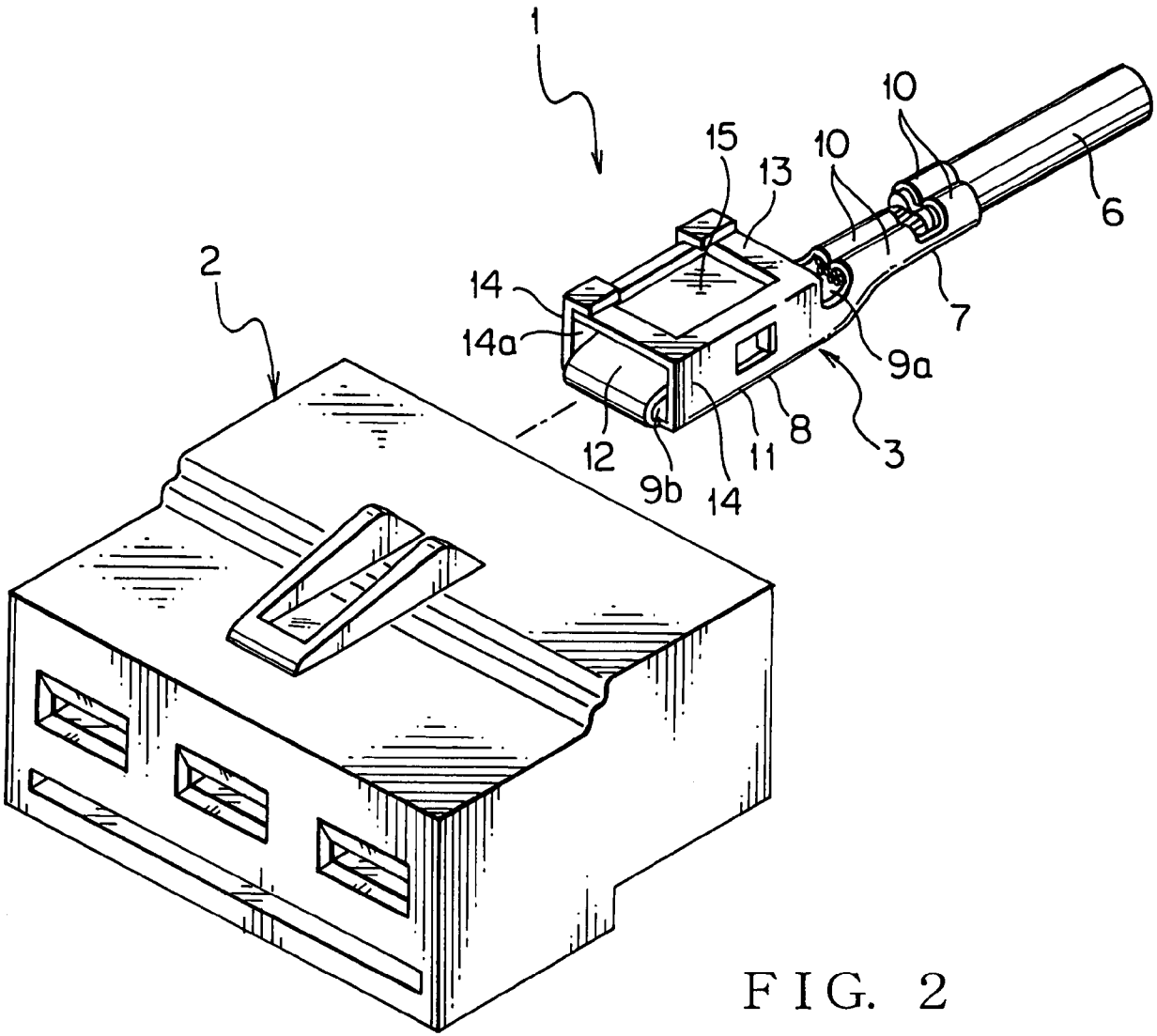
FIG. 2 is an exploded perspective view showing the connector of FIG. 1.

A first embodiment of a connector and a female terminal of the present invention is explained by referring to FIGS. 1-5. A connector 1 includes a connector housing 2 and a female terminal 3 as shown in FIG. 2. The connector housing 2 is made of an insulating synthetic resin and formed in a box shape and has a plurality of receiving chambers for receiving the female terminal 3. The connector housing 2 or the connector 1 is fitted into a mating connector housing 31 of a mating connector 30 as depicted in FIG. 1.

An electrical wire 6 of the female terminal 3 is thus electrically connected to an inserting segment 5 of a male terminal 4. The male terminal 4 can be a male type terminal of an inserting segment such as a busbar or a connecting terminal of an electric element such as relay and fuse.

Referring to FIG. 1, the mating connector 30 includes the mating connector housing 31 and the male terminal 4, and is fitted with the connector housing 2. The male terminal 4 has the inserting segment 5 with a blade shape and is formed with a conductive metal.

Figure 3:
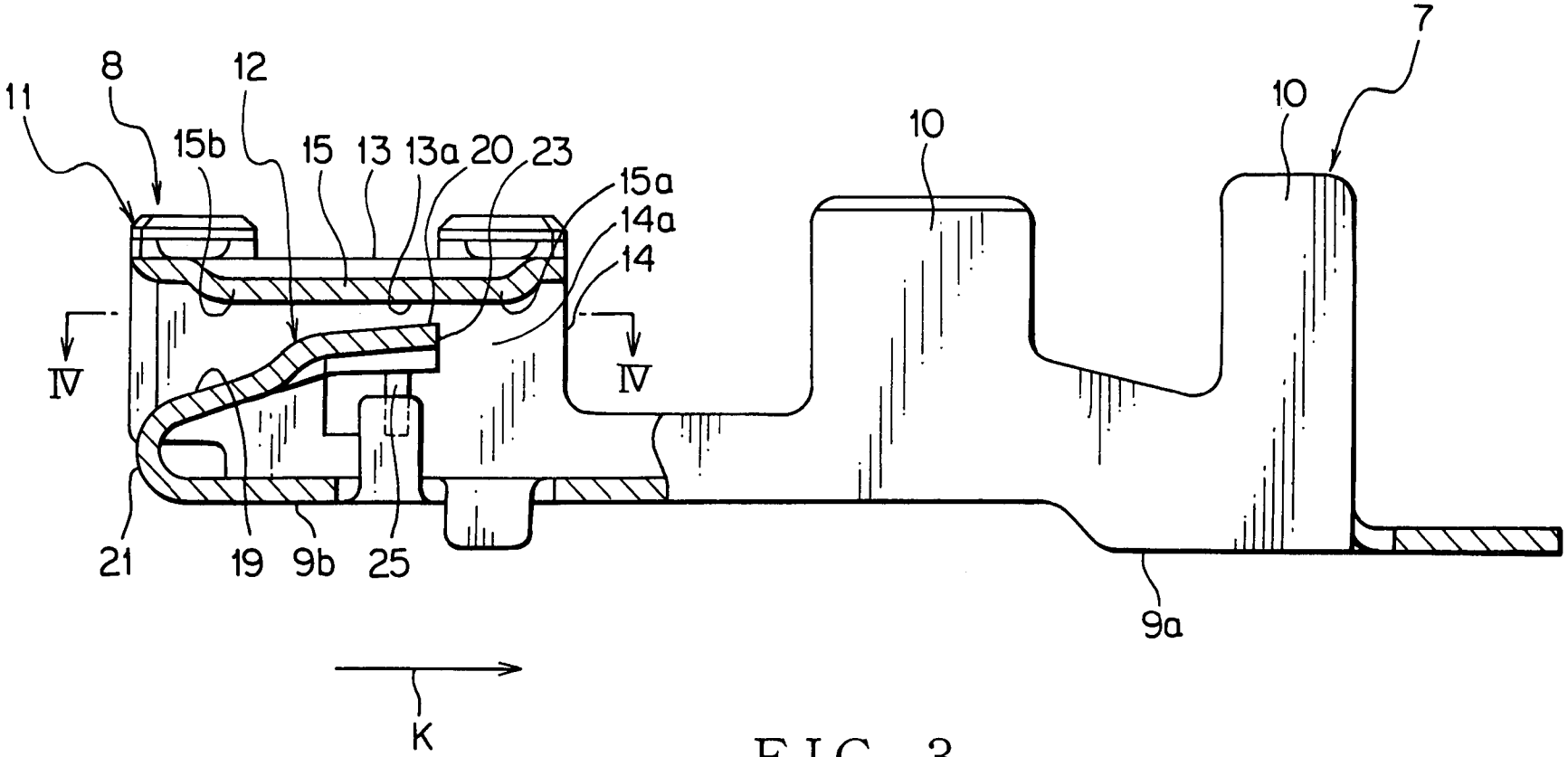
FIG. 3 is a side view with a partial section of a female connector of FIG. 2.

The female terminal 3 is formed by punching and bending a conductive plate. As shown in FIGS. 2 and 3, the female terminal 3 includes an electrical wire connecting portion 7 to be electrically connected to the electrical wire 6, an electrical contacting portion 8 to be electrically connected with the inserting segment 5 of the male terminal 4, and a projection 25 (regulating portion) for regulating the inserting segment 5.

The electrical wire connecting portion 7 has a bottom wall 9*a* and a plurality of crimping segments 10 disposed on both edges of the bottom wall 9*a* along a longitudinal direction thereof. The bottom wall 9*a* is formed in a plate shape and allows a core wire of the electrical wire 6 for resting thereon. The crimping segments 10 disposed on each edge of the bottom wall 9*a* is connected to each other.

An end portion of a core wire exposed from the electrical wire 6 rests on the bottom wall 9*a* of the electrical wire connecting portion 7 and is crimped with the crimping segments 10 so that the electrical wire connecting portion 7 is electrically connected with the electrical wire 6 as shown in FIG. 2.

Referring to FIG. 3, the electrical contacting portion 8 is connected to the electrical wire connecting portion 7, and has a tube 11 for accepting the inserting segment 5 through a front opening and a resilient spring piece or resilient piece 12 for electrically connecting with the inserting segment 5. The tube 11 has a flat bottom wall 9*b*, an upper wall 13 opposed to the bottom wall 9*b* with a distance, and a pair of side walls 14 connected with the bottom wall 9*b* and the upper wall 13. The electrical contacting portion 8 has a rectangular chamber bounded by the walls 9*b*, 13, 14. The bottom walls 9*a* and 9*b* are connected together and are integral.

The bottom wall 9*b* has a rectangular shape and the same width as that of the bottom wall 9*a* of the electrical wire connecting portion 7.

The upper wall 13 has a rectangular shape similar to the bottom wall 9*b* and is disposed parallel to the bottom wall 9b and has a contacting projection 15. The contacting projection 15 has a straight shape and is disposed parallel to the upper wall 13 and the bottom wall 9*b* at the center of one inner wall 13*a* of the upper wall 13 and projects toward the bottom wall 9*b*. The contacting projection 15 is formed along a longitudinal direction of the inserting segment 5 to be inserted into the tube 11, and disposed on the one inner wall 13*a* of the upper wall 13.

The side walls 14 are connected to the bottom wall 9*b* and the upper wall 13, and opposed to each other. The side walls 14 each have another inner wall 14*a*.

The inserting segment 5 is received between the bottom wall 9*b* and the contacting projection 15 and between the opposing side walls 14. The inserting segment 5 is removable along the longitudinal direction, denoted as K, of the upper wall 13.

Figure 4:
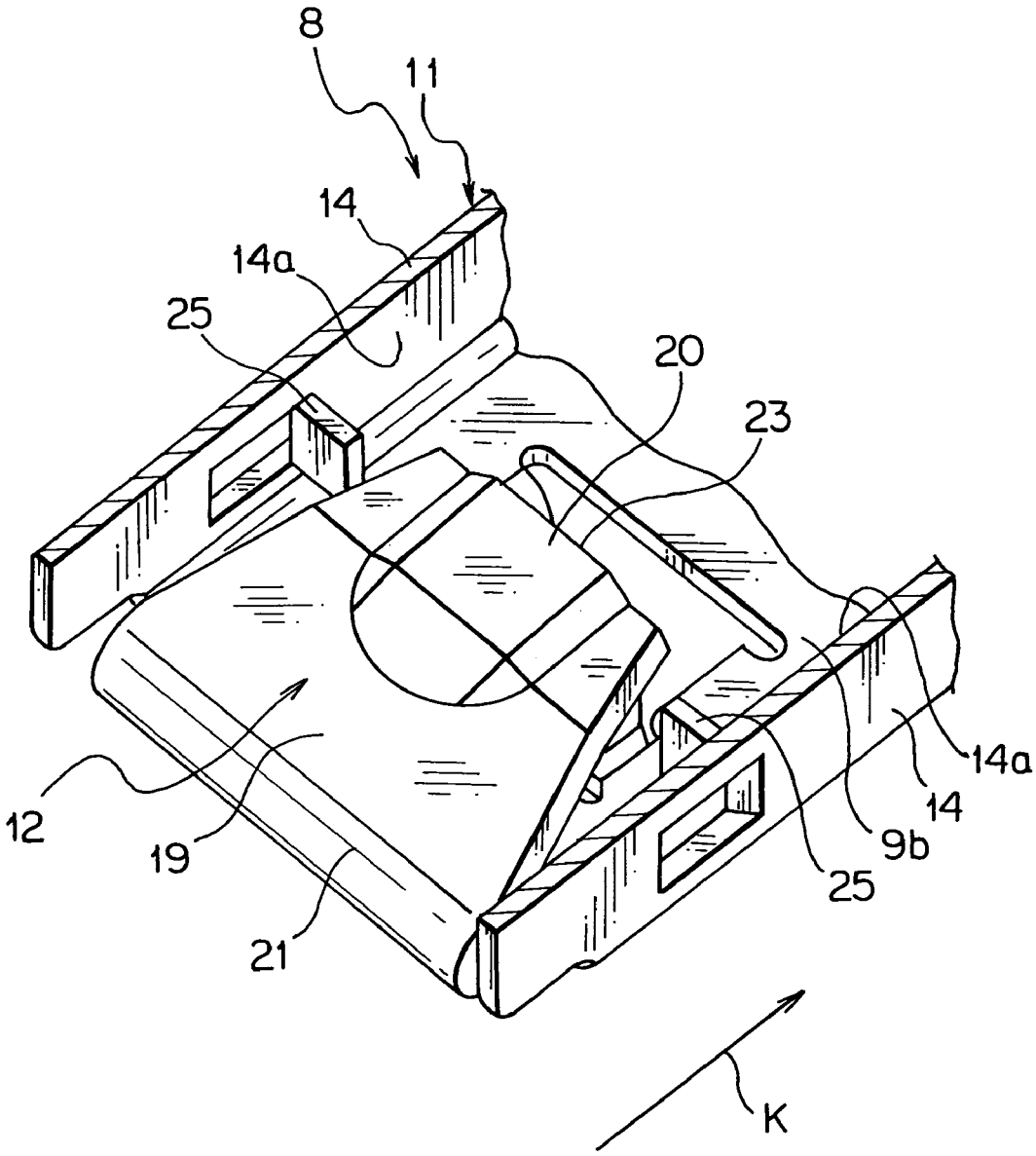
FIG. 4 is a perspective view showing a sectional view taken along the line IV-IV of FIG. 3.

Referring to FIGS. 3 and 4, the spring piece 12 (resilient piece) is formed in a belt-shape and has one end 21 connected to the bottom wall 9*b* and another end 23, which is away from the one end 21 and free. The spring piece 12 is bent so as to position the another end 23 inside the tube 11.

The one end 21 of the spring piece 12 is disposed in the side to accept the inserting segment 5 and the another end 23 is disposed in the opposite side against the one end 21. The spring piece 12 is integral with a leading-in portion 19 and a top portion 20.

Figure 5:
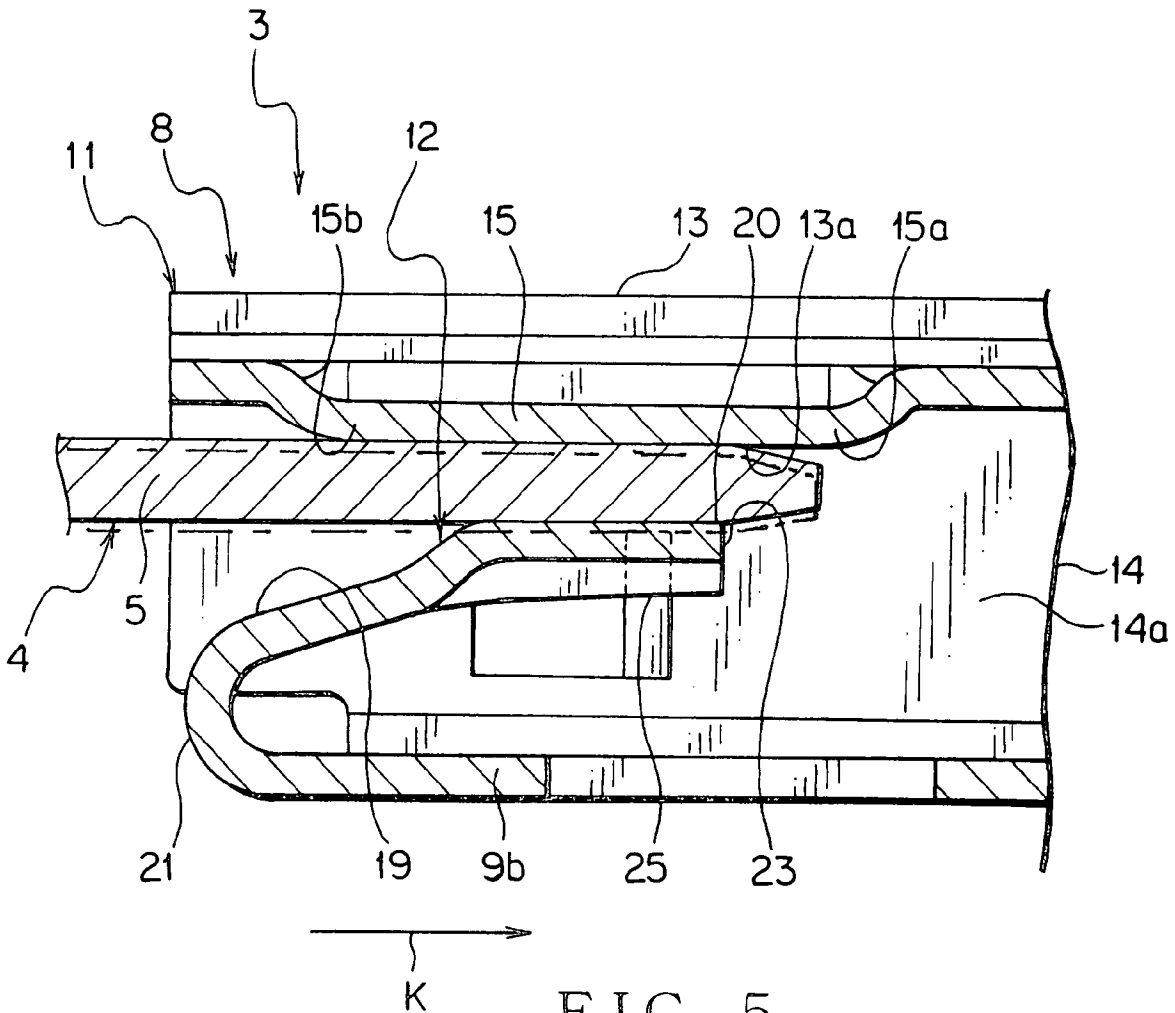
FIG. 5 illustrates that an inserting segment is inserted in a tube of the female terminal of FIG. 3.

The leading-in portion 19 has a trapezoidal shape in view of plan as shown in FIG. 4 and is disposed close to the one end 21. The leading-in portion 19 is angled against the bottom wall 9*b* and extended from the one end 21 to the upper wall 13 as shown in FIG. 5 so as to guide the inserting segment 5 between the spring piece 12 and the contacting projection 15.

The top portion 20 is disposed close to the another end 23 and extends from the another end 23 into the leading-in portion 19. The top portion 20 is bent so as to approach the spring piece 12 to the upper wall 13. The top portion 20 is the closest position of the spring piece 12 to the upper wall 13 and allows the inserting segment 5 to rest thereon.

The top portion 20 of the spring piece 12 is resiliently deformable toward the bottom wall 9*b* so that the another end 23 of the spring piece 12 urges the inserting segment 5 against the contacting projection 15 for holding the inserting segment 5 between the spring piece 12 and the one inner wall 13*a*.

A pair of projections 25 each are disposed on the side wall 14 and the respective projection 25 has a rectangular shape in plan view.

The pair of the projections 25 are formed by cutting out the respective side walls 14 and extended inwardly from the another inner wall 14*a* of the tube 11. The projections 25 are disposed between the another end 23 and the bottom wall 9*b*.

The projections 25 are apart from the upper wall 13 to position the inserting segment 5 and disposed close to a rear end 15*a* of the contacting projection 15.

When the inserting segment 5 is inserted between the one inner wall 13*a* and spring piece 12, the inserting segment 5 is moved vertically away from the one inner wall 13*a* and abuts the projections 25. The inserting segment 5 is thus regulated to move over a prescribed distance from the one inner wall 13*a*.

The electrical wire 6 is attached to the electrical wire connecting portion 7 of the female terminal 3 and the female terminal 3 is inserted into the terminal receiving chamber of the connector housing 2 for assembling the connector 1. An electrical wire is then attached to the male terminal 4 and the male terminal 4 is inserted into a terminal receiving chamber of the mating connector housing 31 to assemble the mating connector 30. The connector 1 and the mating connector 30 are fitted together so that the inserting segment 5 of the male terminal 4 is inserted into the tube 11 of the female terminal 3.

The electrical connection between the connector 1 and the mating connector 30 is explained. The inserting segment 5 is moved toward the tube 11 along the direction K by approaching the connector 1 and the mating connector 30 each other. The inserting segment 5 then abuts the leading-in portion 19 and a slope near a front end 15*b*, and is guided thereby so as to be guided between the top portion 20 of the spring piece 12 and the contacting projection 15.

As the inserting-segment 5 is moved toward the direction K, the inserting segment 5 resiliently deforms the spring piece 12 and opens up the gap between the top portion 20 and the contacting projection 15. The inserting segment 5 is pressed with the spring piece 12 against the contacting projection 15 disposed on the one inner wall 13*a* of the upper wall 13. When the inserting segment 5 is further inserted inwardly the tube 11, the another end 23 of the spring piece 12 opposes the projections 25 as shown in FIG. 5 and the inserting segment 5 is positioned between the top portion 20 and the contacting projection 15 so that the connection of the connector 1 and the mating connector 30 is achieved.

When the inserting segment 5 is separated away from the upper wall 13 or the contacting projection 15, as indicated by a dot-dash line in FIG. 5, the inserting segment 5 abuts on the projections 25.

The projections 25 (regulating portions) thus regulate the inserting segment 5 to be separated from the one inner wall 13*a* by a certain distance. The regulation of the separation of the inserting segment 5 prevents a plastic deformation of the spring piece 12 and also rubbing between the inserting segment 5 and the spring piece 12. A plated layer of the spring piece 12 is thus prevented from peeling off and from forming an oxide film due to a fretting corrosion. The decrease of resistance between both male and female terminals 3 and 4 is thereby prevented.

Figure 6:
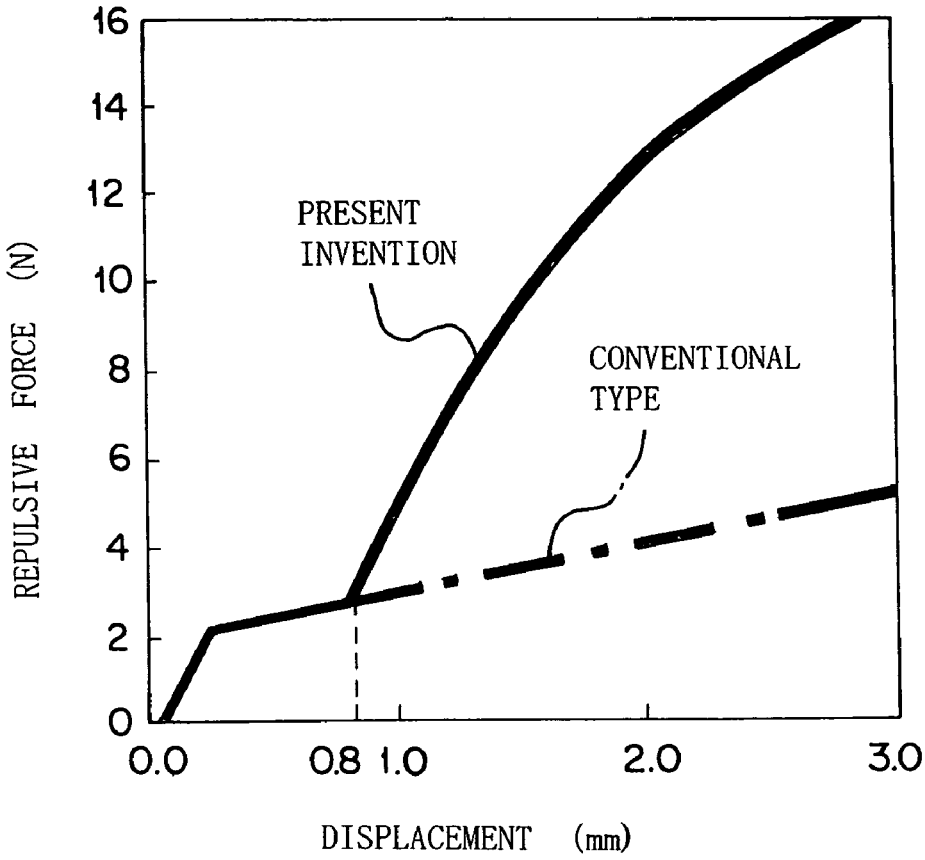
FIG. 6 illustrates a repulsive force to the inserting segment when moved in the terminal of the present invention and a conventional terminal, respectively.

The applicant of the present invention verified the effect of the female terminal 3 of the embodiment. The effect is ascertained with a repulsive force of the spring piece 12 against the inserting segment 5 when the inserting segment 5 is inserted into the female terminal 3 and displaced away from the upper wall 13 in the direction perpendicular to the direction K. FIG. 6 shows the repulsive force of the embodiment and that of the conventional female terminal, which does not have the pair of the projections 25. The abscissa axis of FIG. 6 is a displacement of the inserting segment 5 from the contacting projection 15 of the upper wall 13. The repulsive force is same as a weight to displace the inserting segment 5 in the tube 11 away from the upper wall 13 in the direction perpendicular to the direction K.

As shown in FIG. 6, the repulsive force of the embodiment significantly increases when the displacement is larger than 0.8 mm compared with the conventional female terminal. It is evident that the projections 25 regulate the inserting segment 5 from separating away from the contacting projection 15 disposed on the one inner wall 13*a*.

Figure 7:
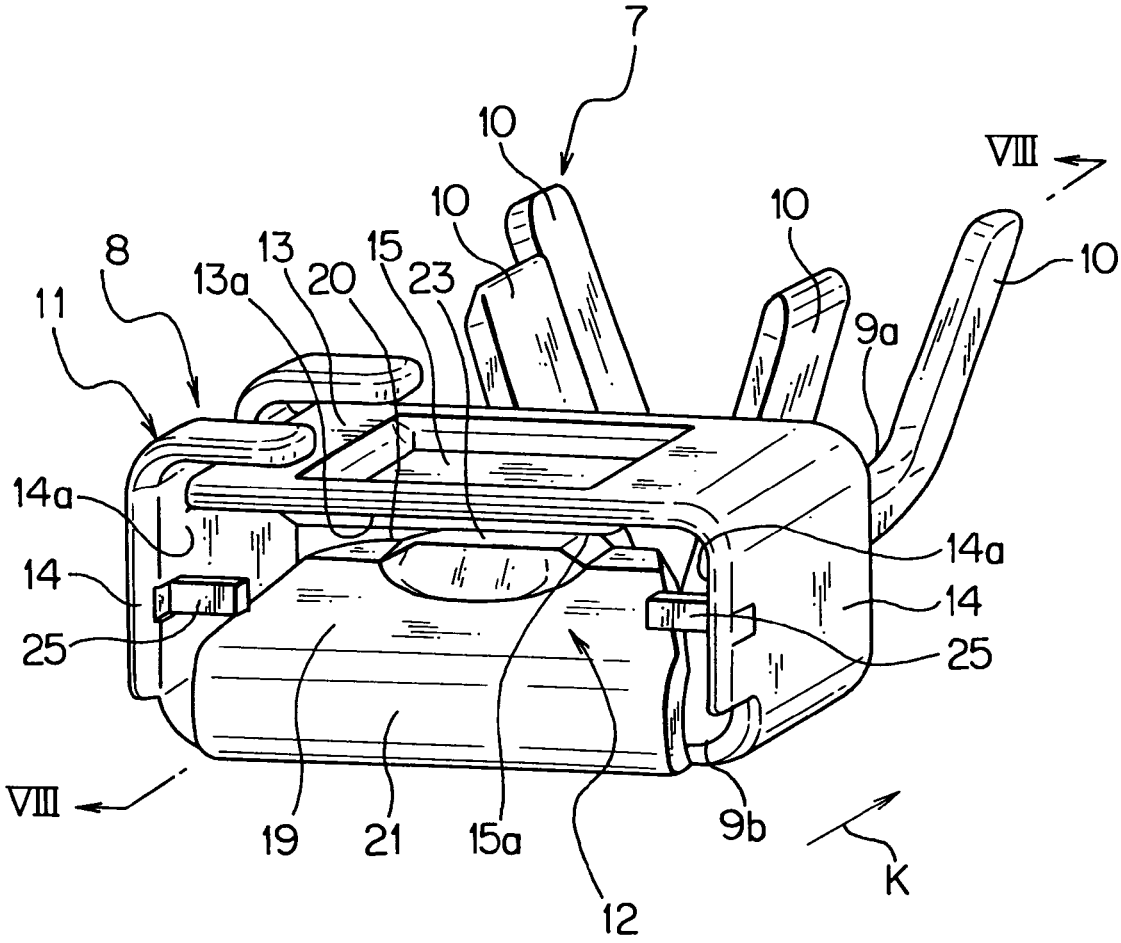
FIG. 7 is a perspective view showing a second embodiment of a female terminal of the present invention.
Figure 8:
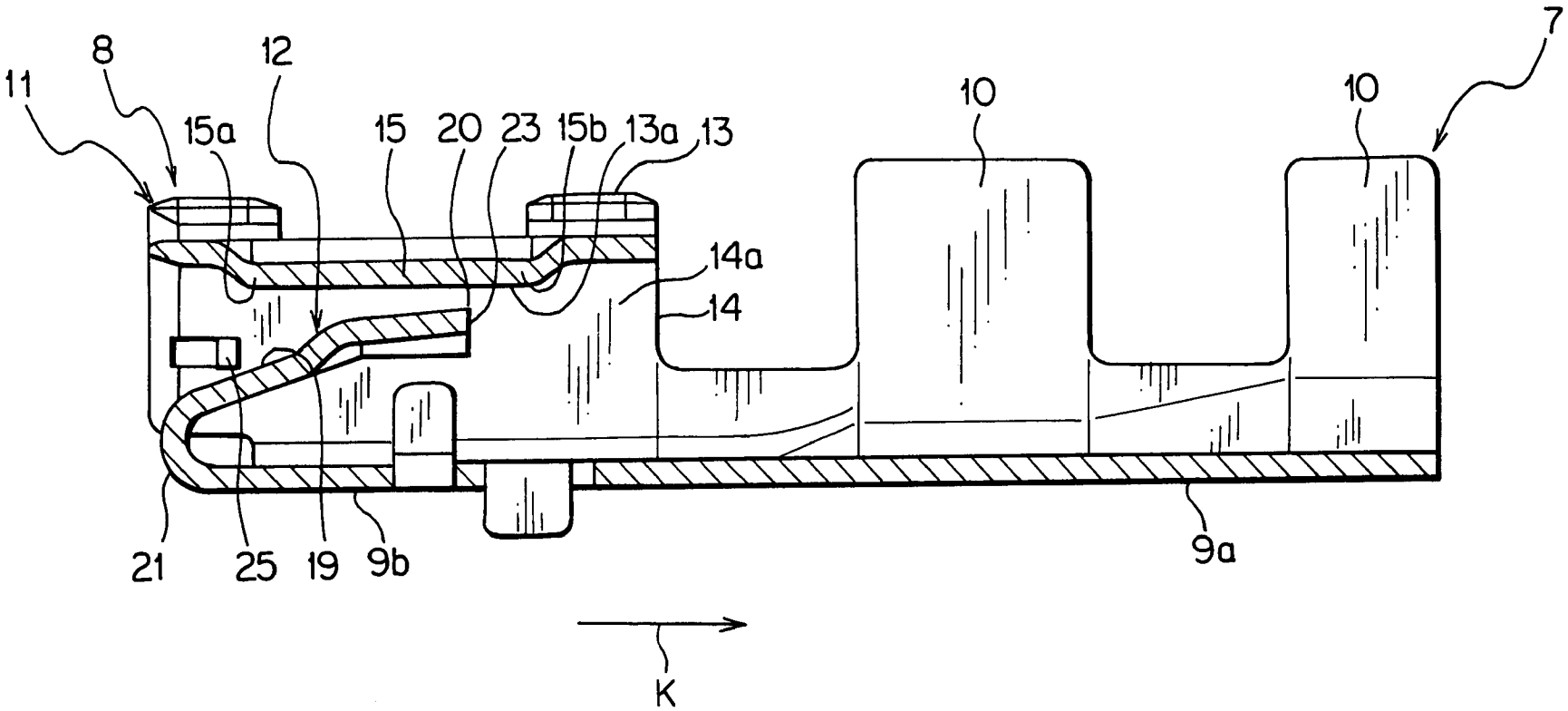
FIG. 8 is a sectional view taken along the line VIII-VIII of FIG. 7.
Figure 9:
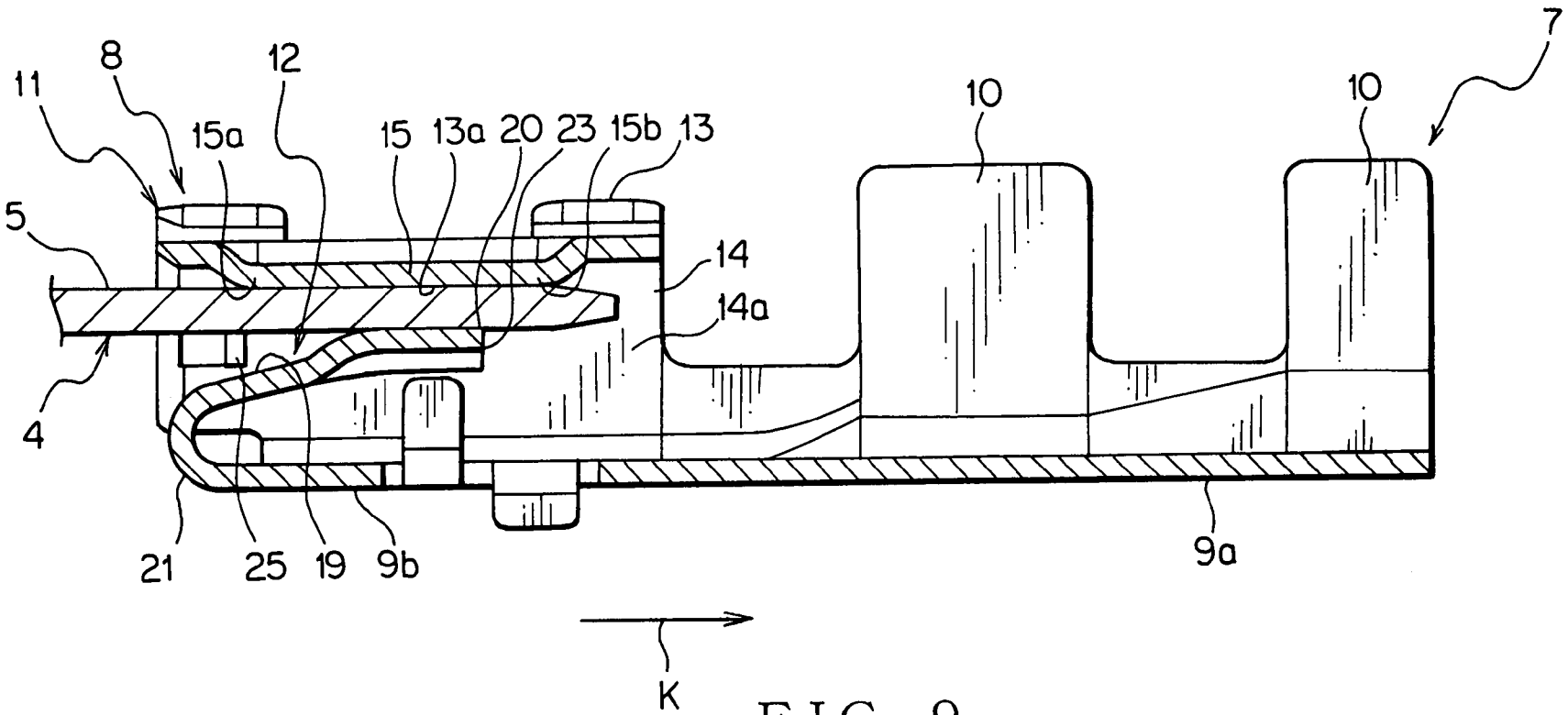
FIG. 9 illustrates that an inserting segment is inserted in a tube of the female terminal of FIG. 8.

Referring to FIGS. 7-9, a second embodiment of a female terminal of the present invention is explained. Like parts are provided with like reference signs.

As shown in FIGS. 7-9, a pair of projections 25 are disposed between a front end 15*a* of a contacting projection 15 and one end 21 of a spring piece 12 of an electrical contacting portion 8.

The projections 25 each have a gap against an inserting segment 5 and are opposed to a lower wall of the inserting segment 5.

When the inserting segment 5 is inserted into a female terminal 3, the inserting segment 5 is displaced away from the contacting projection 15 of an upper wall 13 in a direction perpendicular to a direction K denoted with an arrow and abuts on the projections 25. The projections 25 thus regulate the inserting segment 5 for separating away with a certain distance from one inner wall 13*a* of a tube 11. The female terminal 3 is then received into a connector housing 2 to assemble a connector 1.

In the second embodiment of the present invention, the projections 25 regulate the movement of the inserted segment 5, which is pressed with the spring piece 12 against the one inner wall 13*a*, so as not to separate away from the one inner wall 13*a* by the certain distance, similarly to the first embodiment.

Figure 10:
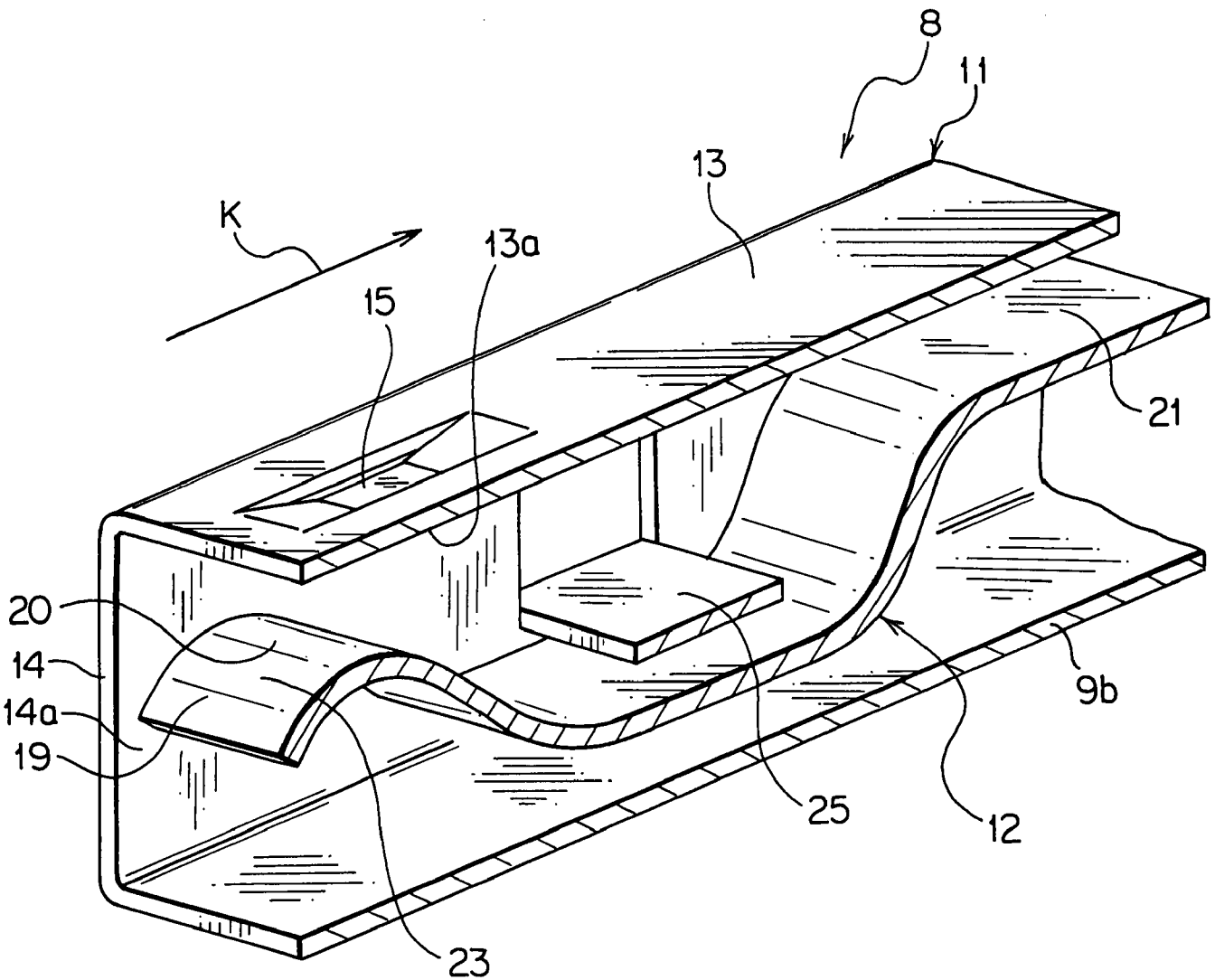
FIG. 10 is a perspective view of a sectional view of a third embodiment of a female terminal of the present invention.
Figure 11:
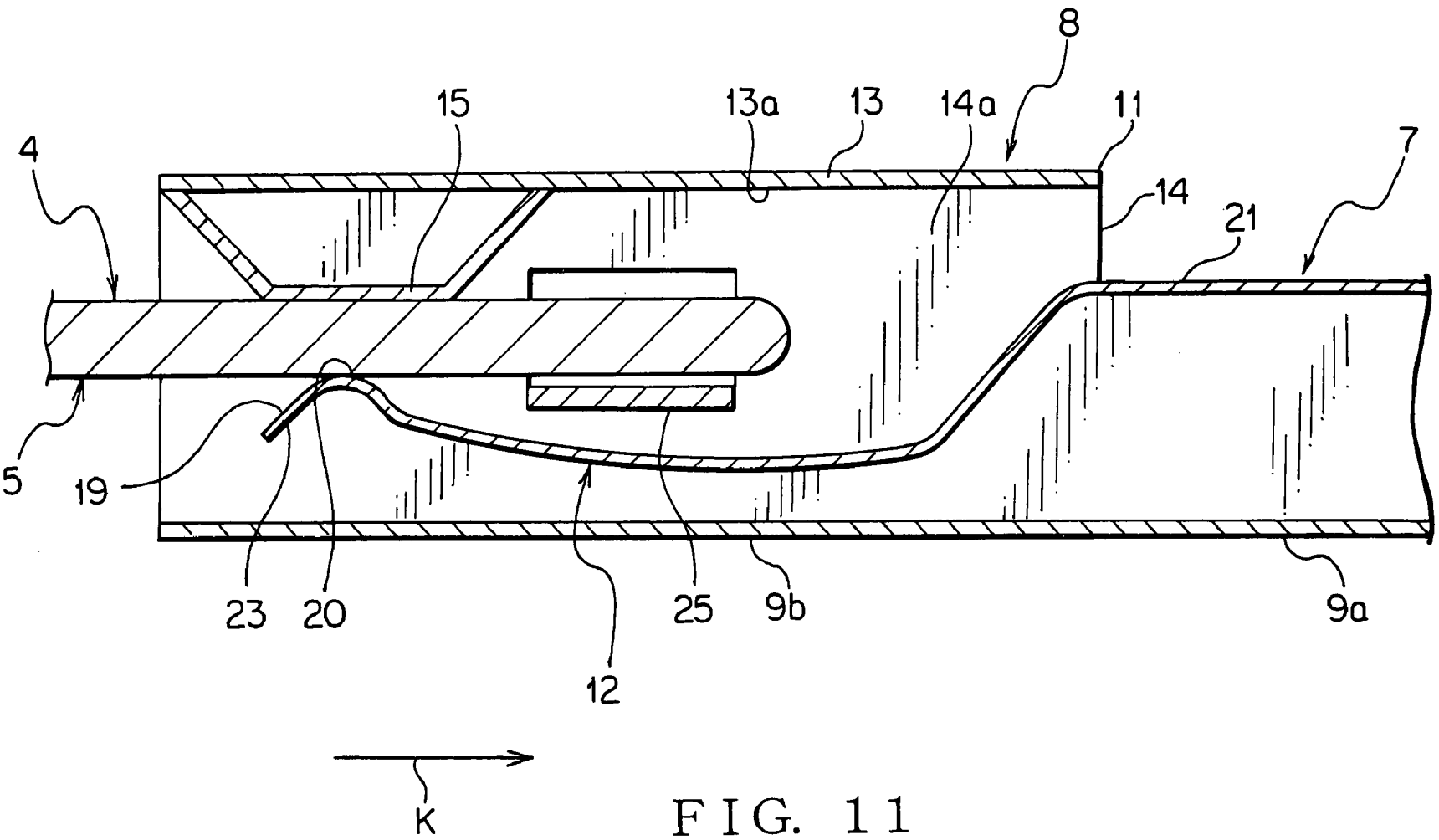
FIG. 11 illustrates that an inserting segment is inserted in a tube of the female terminal of FIG. 10.
Figure 12:
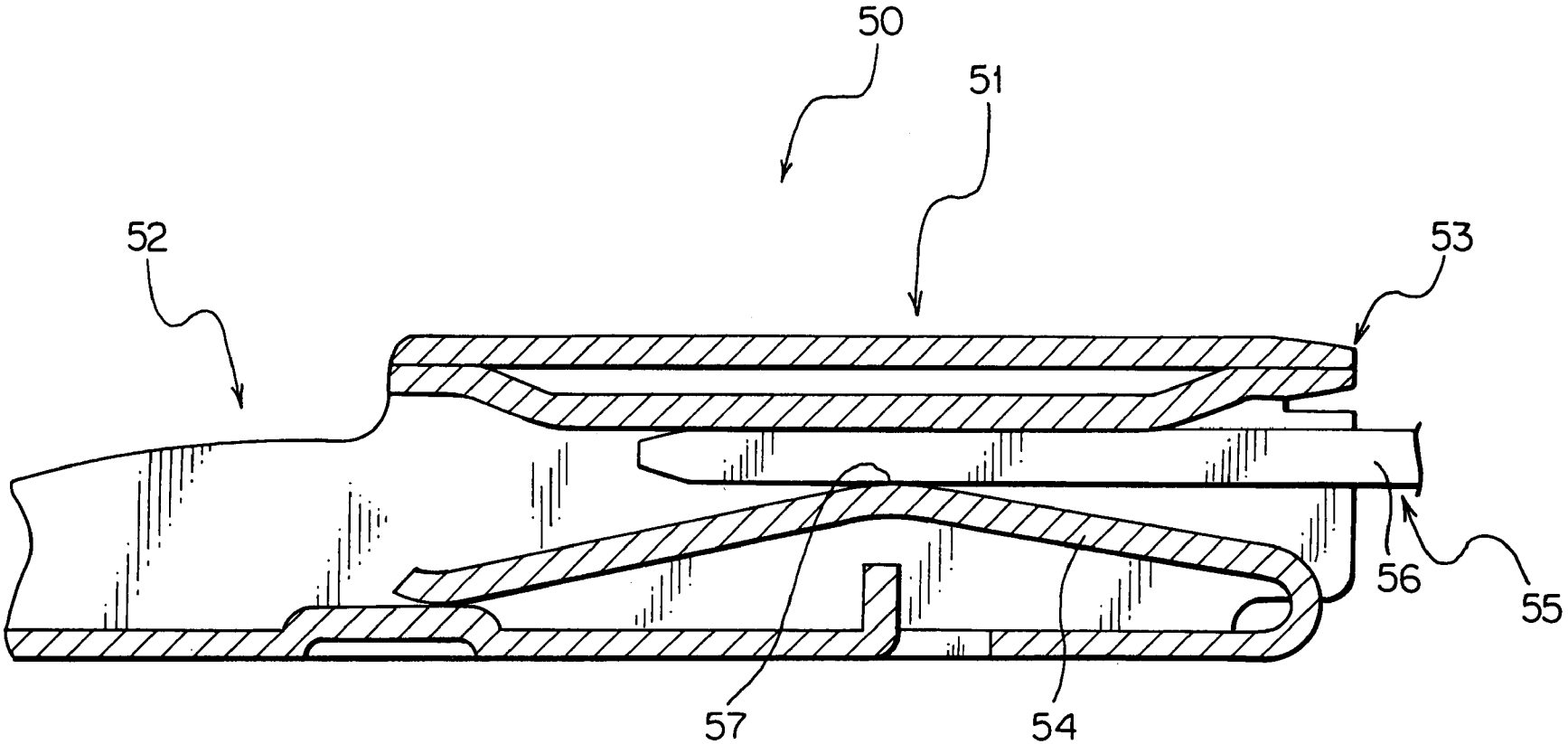
PRIOR ART FIG. 12
FIG. 12 is a sectional view showing that an inserting segment is inserted in a conventional female terminal.

A third embodiment of a female terminal of the present invention is explained by referring to FIGS. 10 and 11. Like portions of the first and second embodiments are provided with like reference signs.

Referring to FIGS. 10 and 11, a pair of projections 25 are disposed inwardly and downwardly from a contacting projection 15. When an inserting segment 5 inserted separates from the contacting projection 15 of an upper wall 13, the inserting segment 5, similarly to the first and second embodiments, abuts on the projections 25 so that the inserting segment 5 is regulated about the movement thereof.

The female terminal 3 prevents an increase of resistance between the inserting segment 5 and the female terminal 3. The projections 25 are disposed apart from the contacting projection 15 so that the inserting segment 5 is assuredly positioned therebetween. The inserting segment 5 is assuredly regulated about the movement thereof in a tube 11 so that an increase of resistance between the inserting segment 5 of a male terminal 4 and the female terminal 3 is prevented.

In the above embodiments, the pair of the projections 25 are disposed on the respective side walls 14. It is appreciated that the plurality of the projections 25 can be disposed on each side wall 14 or one projection 25 can be disposed only on one side wall 14.

In the above embodiments, the inserting segment 5 abuts on the projections 25. Preferably, the spring piece 12 abuts on the projections 25. In any case, preferably, the projection 25 regulates the inserting segment 5 to separate from the upper wall 13.

In the above embodiments, the projections 25 are formed by cutting out the side walls 14 and extended inwardly. Preferably, the projection 25 extends inwardly from the bottom wall 9*b* or the upper wall 13. It is appreciated that the projections 25 are formed and upstanding anywhere as far as the projections abut on either the spring piece 12 or the inserting segment 5 so as to regulate the sliding between the spring piece 12 and the inserting segment 5.

In the above embodiments, the spring piece 12 presses the inserting segment 5 against the contacting projection 15 of the upper wall 13. It is appreciated that the spring piece 12 presses the inserting segment 5 against the bottom wall 9*b* or the side wall 14. It is more generally appreciated that the spring piece 12 presses the inserting segment 5 against one of the inner walls of the tube 11 and the projection is upstanding from another inner wall.

It is appreciated that regulating pieces other than the projections 25 are also adapted.

The embodiments of the present invention are only exemplary and not limited thereto. Any modification and alteration are within the scope of the present invention.

What is claimed is:

1. A female terminal comprising:

an electrical wire connecting portion to be connected with an electrical wire; and an electrical contacting portion having a tube shape and connected to the electrical wire connecting portion, the electrical contacting portion having a tube, with a bottom wall, for accepting an inserting segment of a mating terminal, a resilient piece, and a regulating portion, wherein the resilient piece urges the inserting segment against one inner wall of the tube and the regulating portion regulates the inserting segment to move away from the one inner wall and where the regulating portion is a projection extending inwardly from another inner wall and is arranged to directly abut the inserting segment when the inserting segment separates away from the one inner wall, with the projection disposed between the inserting segment and the bottom wall of the tube.

2. The female terminal as claimed in claim 1, further comprising a contacting projection having a flat shape and disposed on the one inner wall in a longitudinal direction of the inserting segment so as to sandwich the inserting segment between the contacting projection and the resilient piece, wherein the projection is disposed at an opening portion of the electrical contacting portion and between the inserting segment and the resilient piece.

3. The female terminal as claimed in claim 1, further comprising a contacting projection having a flat shape and disposed on the one inner wall in a longitudinal direction of the inserting segment so as to sandwich the inserting segment between the contacting projection and the resilient piece, wherein the projection is disposed opposite to an opening portion of the electrical contacting portion and between the inserting segment and the resilient piece and has a gap with respect to the contacting projection along the longitudinal direction of the inserting segment.

4. A connector having the female terminal as claimed in claim 1.

* * * * *